US005277463A

United States Patent [19]

Singh et al.

[11] Patent Number: 5,277,463

[45] Date of Patent: Jan. 11, 1994

[54] DRILL PIPE HANDLING TOOL

[75] Inventors: Mohinder Singh, Mesquite; Edward A. Szep, Richardson, both of Tex.

[73] Assignee: Ingersoll-Rand Company, Woodcliff Lake, N.J.

[21] Appl. No.: 1,887

[22] Filed: Jan. 8, 1993

[51] Int. Cl.[5] ..... B66C 1/22

[52] U.S. Cl. ..... 294/103.1; 294/67.22

[58] Field of Search ..... 294/4, 11, 15, 16, 34, 294/67.22, 67.3, 67.33, 82.11, 82.13, 103.1, 119.1, 82.17, 82.23

[56] References Cited

U.S. PATENT DOCUMENTS

| | | | |
|---|---|---|---|
| 1,272,359 | 7/1918 | Bell | 294/67.22 X |
| 2,515,918 | 7/1950 | Weeks et al. | 294/67.33 |
| 2,789,716 | 4/1957 | Wolf | 294/119.1 X |
| 2,789,858 | 4/1957 | Kughler | 294/67.33 |
| 4,135,655 | 1/1979 | Brown | 294/16 X |

FOREIGN PATENT DOCUMENTS

| | | | |
|---|---|---|---|
| 679790 | 8/1939 | Fed. Rep. of Germany | 294/103.1 |
| 227676 | 9/1985 | German Democratic Rep. | 294/67.33 |
| 8701885 | 3/1989 | Netherlands | 294/67.33 |
| 603614 | 4/1978 | U.S.S.R. | 294/82.13 |
| 1197978 | 12/1985 | U.S.S.R. | 294/67.22 |
| 578498 | 7/1946 | United Kingdom | 294/82.13 |

*Primary Examiner*—Johnny D. Cherry
*Attorney, Agent, or Firm*—John J. Selko

[57] ABSTRACT

A tool for handling an elongated, tubular drill pipe has an elongated body between a first and second end for engaging and holding a first and second end of the drill pipe. The engagement ends of the tool are spaced apart a distance slightly less than the length of the drill pipe. The engagement ends are capable of being elastically spread apart when the drill pipe is being engaged, and thereafter the elastic spreading is released to cause the tool to remain in engagement with the drill pipe during the handling thereof.

9 Claims, 3 Drawing Sheets

DRILL PIPE HANDLING TOOL

BACKGROUND OF THE INVENTION

This invention relates generally to the handling of elongated tubular drill pipe, and more particularly to tools for handling elongated drill pipe for insertion into a drill rig during the drilling operation.

Many versions of tools and/or devices currently exist to lift and maneuver drill pipe from a stowed position, to a working position on a drill rig. The stowed position usually is horizontal, or nearly so, in a rack, on the ground, or on a transport such as a separate truck or trailer type vehicle. The working position is normally in a vertical attitude inside a drilling derrick. A major shortcoming of these devices is that they are susceptible to accidental dropping of the drill pipe as it gets dislodged from the handling/lifting tool in its transition from the horizontal stowed position to the vertical working position, above ground level in a drill rig.

This problem is so common because the devices are designed to be easily applied on and removed from the drill pipe, so not to take time and effort away from the drilling functions. During the lifting and maneuvering of the heavy drill pipe in close proximity to the drill rig and its many components, the devices tend to become inadvertently either slid out of position, unlatched, or released, to a point where the drill pipe becomes unstable or ultimately is dropped.

The foregoing illustrates limitations known to exist in present tools for handling elongated tubular drill pipe. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a tool for handling an elongated, tubular drill pipe of a predetermined length, the tool having first end engagement means for engaging and holding a drill pipe at a first end; a second end engagement means for engaging and holding a drill pipe at a second end; an elongated body member extending between the first end and the second end engagement means, spacing apart the first end and the second end engagement means a distance less that the predetermined drill pipe length; and means for permitting elastic spreading apart of the first end engagement means and the second end engagement means a distance greater than the predetermined drill pipe length, to engage and hold the drill pipe, and for thereafter elastically retaining the first end engagement means and the second end engagement means in the drill pipe during movement of the drill pipe.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
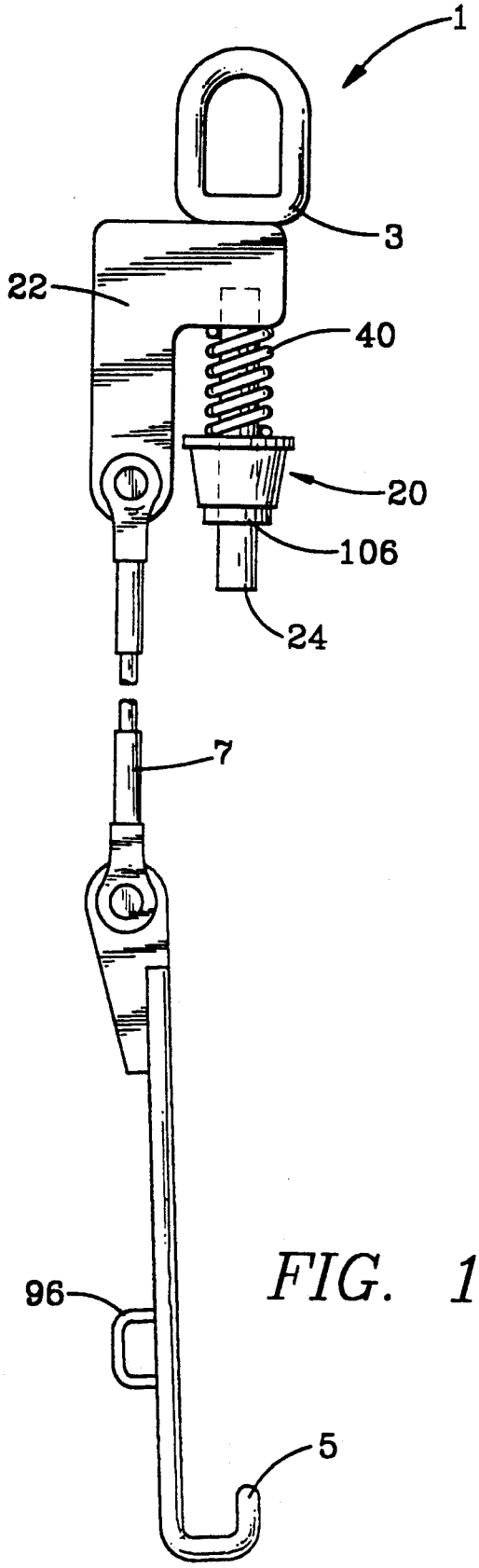
FIG. 1 is a side elevational view, with parts removed, of the tool without a drill pipe engaged therein.

Now referring to the drawings, FIG. 1 shows the tool of the invention shown generally as 1, having a first end engagement means 3 for engaging and holding a first end of a drill pipe (not shown), and a second end engagement means 5 for engaging and holding a second end of a drill pipe. As is well known, drill pipe for a given drilling operation is of a standard predetermined length.

Tool 1 also includes an elongated body member 7 extending between first and second end engagement means 3 and 5, spacing apart such engagement means a distance slightly less than the predetermined length of the drill pipe.

Shown generally as 20 is a means for permitting elastic spreading apart of a portion of said first end engagement means 3 and said second end engagement means 5 a distance greater than the predetermined drill pipe length, to engage and hold the drill pipe, and for thereafter elastically retaining the first end engagement means and the second end engagement means, 3 and 5 respectively, in the drill pipe during movement of the drill pipe, as will be more fully described hereinafter.

Figure 3:
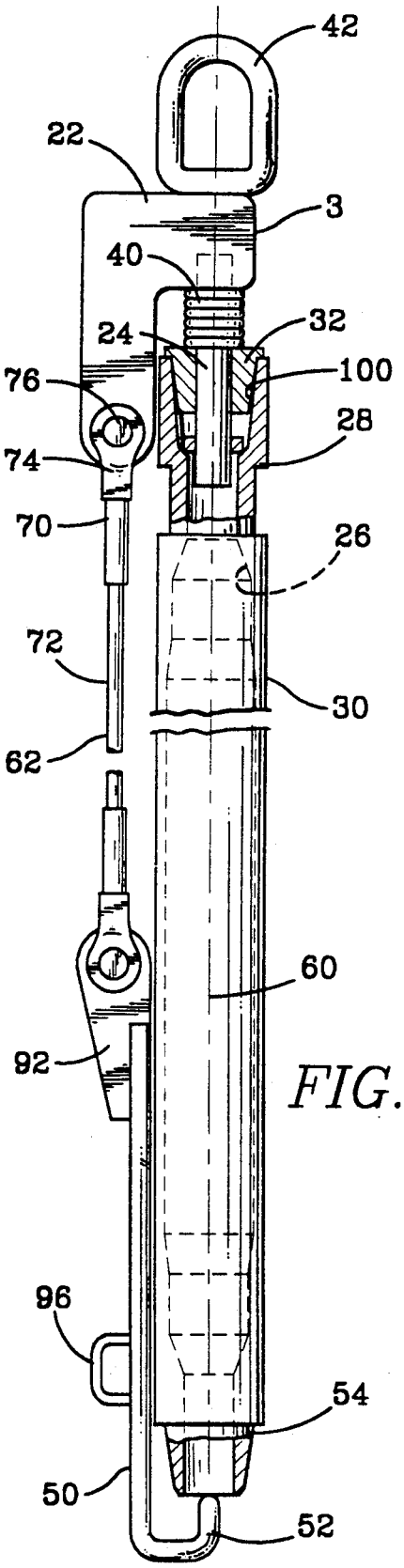
FIG. 3 is a side elevational view, in partial cross-section, with parts removed, of the tool with a first end of a drill pipe engaged therein.
Figure 4:
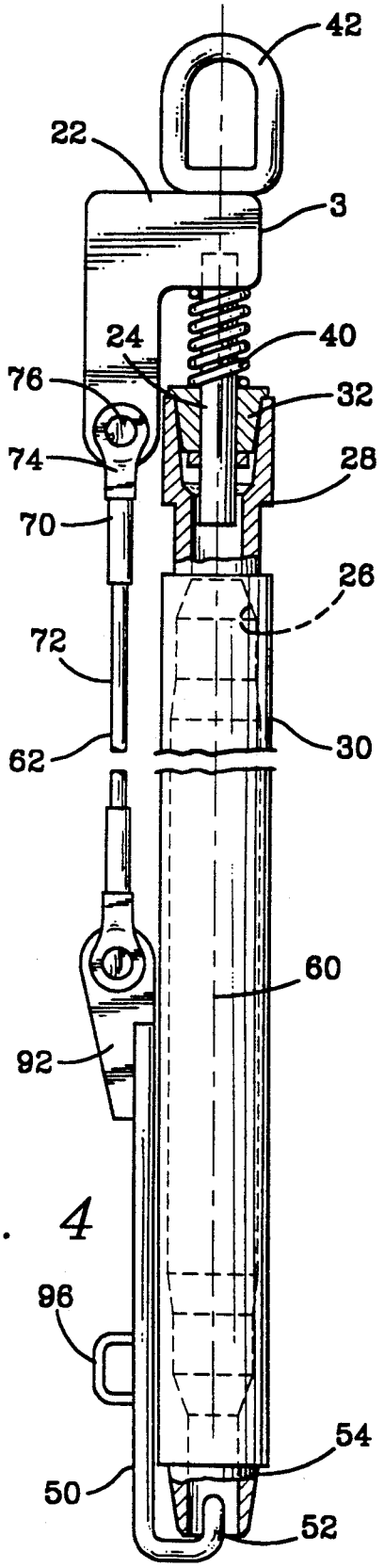
FIG. 4 is a view similar to FIG. 3 with a drill pipe completely engaged in the tool.

As shown in FIGS. 3 and 4, first end engagement means 3 is a lifting bail assembly having a mounting head member 22 with a shaft 24 extending therefrom, and adapted to extend within a bore 26 of a first end 28 of a drill pipe 30. A plug 32 is slidably mounted on shaft 24 and is adapted to engage and hold a first end 28 of drill pipe 30. An elastic compression spring means 40 is slidably mounted o shaft 24 between mounting head 22 and plug 32, for permitting first and second end engagement means, 3 and 5 respectively, to be spread apart to engage a drill pipe 30. When a drill pipe 30 is not engaged, the compression spring means 40 is relaxed. A lifting eye, or bail, 42 is mounted on mounting head 22, spaced on an opposite side thereof, with respect to shaft 24.

Second end engagement means 5 is simply a hook member 50 that has an arm 52 extending in reverse direction to body member 7, for engaging and holding second end 54 of drill pipe 30.

Mounting head 22 extends outwardly from axis 60 of bore 26 a distance for positioning of body member 7 along an axis parallel to, but spaced from and alongside of, the axis 60 of bore 26. Mounting head 22 can be a wrought member or a casting. Body member 7 is pivotally connected to mounting head 22, for operation, as described hereinafter.

Figure 2:
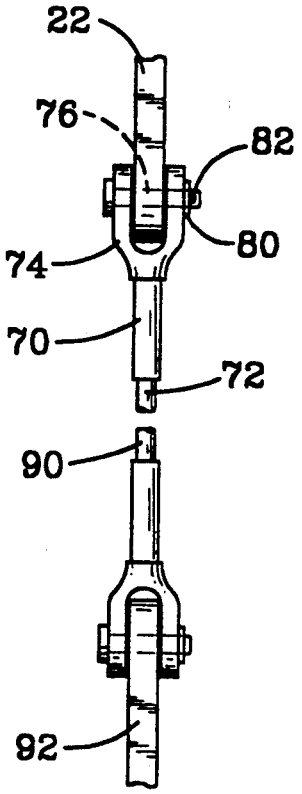
FIG. 2 is a front elevational view, with parts removed, of the tool shown in FIG. 1.

We prefer body member 7 to have at least a middle portion 62 of its length made from a flexible cable so the tool can be coiled, when not in use, for storage and transport. As shown in FIG. 2, body member 7 is a cable assembly having a crimp socket 70 at a top end 72 of the cable. Attached to crimp socket 70 is a clevis 74 that is journaled around a shaft 76, that extends through mounting member 22. Clevis 74 is held in place by washer 80 and pin 82 through shaft 76. A similar crimp socket and clevis arrangement is used to connect bottom end 90 of body member 7 to attachment member 92, which attachment member 92 can be a plate or solid bar. Attachment member 92 has hook member 50 at the end thereof. A handle 96 is intended for the operator to use to elastically spread apart the first and second ends of the tool, and guide the tool during operation.

As is well known, drill pipe 30 has a box joint configuration at first end 28 and a pin joint configuration at second end 54. A box joint is formed by internal surface walls 100 of the drill pipe tapering inwardly toward a mid-body location on the longitudinal axis 60 of bore 26, with threads on the tapered surface for joining to a pin joint end of the next pipe. A pin joint end is formed by the external surface of the drill pipe tapering outwardly toward a mid-body location on axis 60 of bore 26, with threads on the tapered surface for joining with the box end of the next pipe. For added stability of engagement and holding, with a box joint end pipe, plug 32 should be generally tapered to follow the taper of the box joint end. Plug 32 is slidable along shaft 24, and held in place by stop 106 (FIG. 1) at the bottom surface thereof.

We prefer to position shaft 24, spring means 40, lifting eye 42 and hook member 50 along an axis that is substantially coincident with the axis 60 of bore 26, so that the drill pipe will be lifted in a substantially vertical position, for increased stability, during operation.

Figure 5:
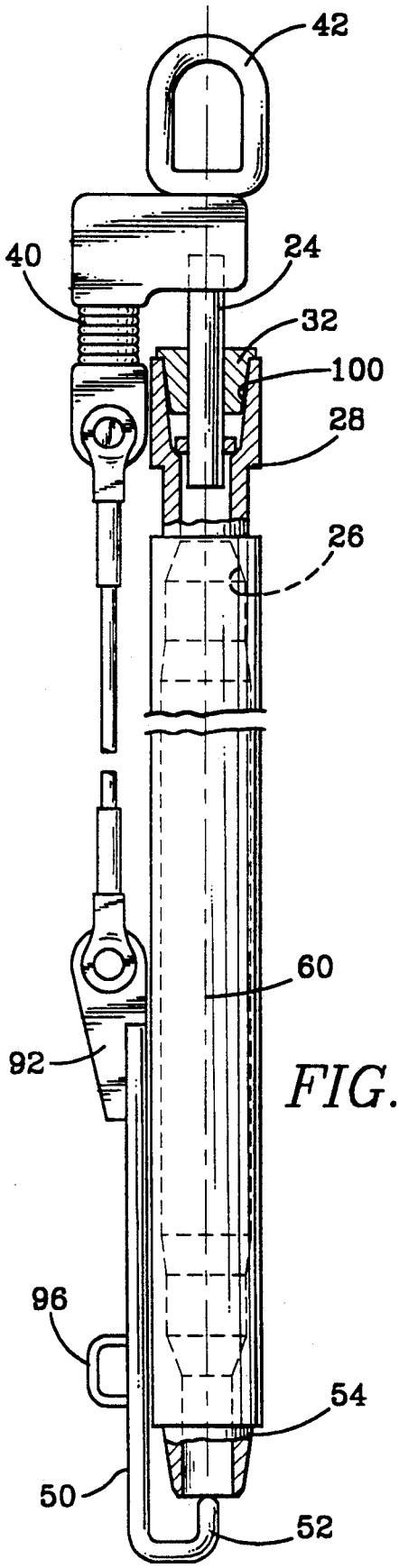
FIG. 5 is an alternate embodiment of the tool, similar to FIG. 3, but with the elastic compression means in the body member.

While we have shown the elastic spring means 40 along the axis of the shaft 24, it could be placed along the axis of the body member 22, as shown is FIG. 5.

In operation the tool is used as follows: To attach the tool to the drill pipe 30, the operator inserts the lifting bail assembly plug shaft 24 into the box joint end of the drill pipe. The operator then takes the hook 50 and handle 96 end of the tool to the pin joint end of the drill pipe, and inserts the hook 50, into the end of the pipe by pulling the body member 7 axially along the drill pipe to compress spring 40, until he can clear the pin joint end and put the hook 50 in line with the pipe bore 26. Once the tool is in line, he may release the pull tension and the spring 40 will extend, pulling and holding the hook arm 52 inside the pin joint end. The spring tension is specifically designed to counteract the weight of the tool so that even if the drill pipe is caught on some part of the rig, and the hoist that is moving the tool and pipe continues, the tool will not slip or come off the pipe. This is especially important when the tool is used to load the drill pipe into a carousel or rod loader canister that is designed to hold/stage the drill pipe in a vertical position once the tool is removed.

To remove the tool, the operator need only to pull the hook end of the tool axially along the drill pipe until the spring 40, is compressed enough to allow the hook 50 to clear the pin joint end. Once the hook 50 is clear, the upper or box joint end 3 may be lifted off the pipe by means of the hoist used to lift the pipe and tool.

Having described the invention, what is claimed is:

1. A tool for handling an elongated, tubular drill pipe of a predetermined length, said drill pipe having a first end and a second end spaced elongatedly apart, comprising:

a. a first end engagement means for engaging and holding a drill pipe at said first end;

b. a second end engagement means for engaging and holding a drill pipe at said second end;

c. an elongated body member extending between said first end engagement means and said second end engagement means, spacing apart said first end engagement means and said second end engagement means a distance less than said predetermined drill pipe length;

d. means on said first end engagement means for permitting elastic spreading apart of said first end engagement means and said second end engagement means a distance greater than said predetermined drill pipe length, whereby said second end engagement means can be inserted into said second end of a drill pipe; and e. said first end engagement means being a lifting bail assembly comprising:

i. a mounting head member;

ii. a shaft extending therefrom for extending within a bore at said first end of a drill pipe;

iii. a plug slidably mounted on said shaft, for engaging and holding said first end of a drill pipe;

iv. an elastic compression spring means slidably mounted on said shaft between said plug and said mounting head member, for forcing said plug into engagement with said first end of a drill pipe, when said first end engagement means and second end engagement means are spread apart; and v. a lifting eye on said mounting head member.

2. The tool of claim 1 wherein said second end engagement means includes a hook member for engaging and holding a drill pipe second end.

3. The tool of claim 2 wherein said body member extends in an axis alongside an axis of said shaft.

4. The tool of claim 3 wherein said lifting eye and said hook member are positioned along said axis of said shaft.

5. The tool of claim 4 wherein said body member is pivotably connected to said mounting head member.

6. The tool of claim 5 wherein at least a portion of said body member is a flexible cable.

7. The tool of claim 6 wherein said plug is tapered.

8. A tool for handling an elongated, tubular drill pipe of a predetermined length, having a pin joint end and a box joint end spaced elongatedly apart comprising:

a. a pin joint end engagement means for engaging and holding a drill pipe at a pin joint end;

b. a box joint end engagement means for engaging and holding a drill pipe at a box joint end;

c. an elongated body member extending between said pin joint end engagement means and said box joint end engagement means, spacing apart said pin joint end engagement means and said box joint end engagement means a distance less than said predetermined drill pipe length;

d. means on said box joint end engagement means for permitting elastically spreading apart of said pin joint end engagement means and said box joint end engagement means a distance greater than said predetermined drill pipe length, whereby said pin joint end engagement means can be inserted into said pin joint end of said drill pipe; and e. said box joint end engagement means being a lifting bail assembly comprising:

i. a mounting head member;

ii. a shaft extending therefrom for extending within a bore at said box joint end of a drill pipe;

iii. a plug slidably mounted on said shaft, for engaging and holding said box joint end of a drill pipe;

iv. an elastic compression spring means slidably mounted on said shaft between said plug and said mounting head member, for forcing said plug into engagement with said box joint end of a drill pipe, when said pin joint end engagement means and box joint end engagement means are spread apart; and v. a lifting eye on said mounting head member.

9. A tool for handling an elongated, tubular drill pipe of a predetermined length, having a pin joint end and a box joint end spaced elongatedly apart comprising:

a. a pin joint end engagement means for engaging and holding a drill pipe at a pin joint end;

b. a box joint end engagement means for engaging and holding a drill pipe at a box joint end;

c. an elongated body member extending between said pin joint end engagement means and said box joint end engagement means, spacing apart said pin joint end engagement means and said box joint end engagement means a distance less than said predetermined drill pipe length;

d. means on said elongated body member, for permitting elastically spreading apart of said pin joint end engagement means and said box joint end engagement means a distance greater than said predetermined drill pipe length, whereby said pin joint end engagement means can be inserted into said pin joint end of said drill pipe; and e. said box joint end engagement means being a lifting bail assembly comprising:

i. a mounting head member;

ii. a shaft extending therefrom for extending within a bore at said box joint end of a drill pipe;

iii. a plug mounted on said shaft, for engaging and holding said box joint end of a drill pipe; and iv. a lifting eye on said mounting head member.

* * * * *